US008541037B2

(12) United States Patent
Bell

(10) Patent No.: US 8,541,037 B2
(45) **Date of Patent: *Sep. 24, 2013**

(54) PACKAGED BOTTLE BEVERAGE HAVING AN INGREDIENT RELEASE CLOSURE WITH IMPROVED ADDITIVE RELEASE AND METHOD AND APPARATUS THEREOF

(75) Inventor: James Clayton Bell, Blue Ridge, GA (US)

(73) Assignee: Georgia Crown Distributing Co., McDonough, GA (US)

( * ) Notice: Subject to any disclaimer, the term of this patent is extended or adjusted under 35 U.S.C. 154(b) by 324 days.

This patent is subject to a terminal disclaimer.

(21) Appl. No.: 12/988,079

(22) PCT Filed: Apr. 16, 2009

(86) PCT No.: PCT/US2009/040767

§ 371 (c)(1),
(2), (4) Date: Oct. 15, 2010

(87) PCT Pub. No.: WO2009/146192

PCT Pub. Date: Dec. 3, 2009

(65) Prior Publication Data

US 2011/0045143 A1 Feb. 24, 2011

Related U.S. Application Data

(63) Continuation-in-part of application No. 12/103,916, filed on Apr. 16, 2008, now Pat. No. 8,142,827.

(51) Int. Cl.
*B65D 81/32* (2006.01)

(52) U.S. Cl.
USPC ..... 426/115; 426/120; 426/394; 426/397; 426/404; 426/413; 53/405; 53/486; 53/289; 53/300; 53/287; 206/219

(58) Field of Classification Search
USPC ..... 426/111, 115, 120, 119, 392, 394, 426/397, 413, 404, 118, 131, 590–599, 395, 426/410; 206/219–222, 807; 53/432, 486, 53/287, 300, 302–303, 317–319, 331.5, 485, 53/490, 314, 329, 439, 530, 289, 403, 405, 53/408, 79, 467; 215/262
See application file for complete search history.

(56) References Cited

U.S. PATENT DOCUMENTS 2,176,557 A * 10/1939 Lippold ..... 53/281
2,324,312 A * 7/1943 Meyer et al. ..... 198/463.4

(Continued)

FOREIGN PATENT DOCUMENTS

WO 03/055758 7/2003
WO WO2009146192 12/2009

OTHER PUBLICATIONS

European National Phase of PCT/US2009/040767 Supplemental European Search Report, Jan. 19, 2012.

*Primary Examiner* — Drew Becker
*Assistant Examiner* — Luana Z Long
(74) *Attorney, Agent, or Firm* — Withers & Keys, LLC

(57) ABSTRACT

A packaged bottle beverage has a base component of the beverage in a container wider vacuum separate from an additive in a sealed compartment of an ingredient release closure. Upon opening the sealed compartment, suction is created forcing the additive to quickly and thoroughly exit the ingredient release closure, a region of relatively higher pressure, and flow into the base component in the container, a region of relatively lower pressure.

20 Claims, 6 Drawing Sheets

(56) References Cited

U.S. PATENT DOCUMENTS

| | | | | | |
|---|---|---|---|---|---|
| 3,220,153 | A | * | 11/1965 | Cormack, Jr. et al. | 53/432 |
| 3,295,293 | A | | 1/1967 | Lodding | |
| 3,457,694 | A | | 7/1969 | Tatibana | |
| 3,491,803 | A | | 1/1970 | Galik | |
| 3,590,557 | A | | 7/1971 | Vogel | |
| 3,674,060 | A | | 7/1972 | Ruekberg | |
| 3,714,760 | A | * | 2/1973 | Roberts et al. | 53/510 |
| 3,945,174 | A | | 3/1976 | Franz | |
| 3,973,603 | A | | 8/1976 | Franz | |
| 3,998,030 | A | * | 12/1976 | Straub | 53/471 |
| 4,102,451 | A | | 7/1978 | Clarke et al. | |
| 4,338,765 | A | | 7/1982 | Ohmori et al. | |
| 4,497,855 | A | | 2/1985 | Agrawal et al. | |
| 4,642,968 | A | | 2/1987 | McHenry et al. | |
| 4,889,250 | A | | 12/1989 | Beyer | |
| 4,905,450 | A | | 3/1990 | Hansen et al. | |
| 4,939,890 | A | * | 7/1990 | Peronek et al. | 53/486 |
| 5,000,314 | A | | 3/1991 | Fuller et al. | |
| 5,014,492 | A | | 5/1991 | Fiorini et al. | |
| 5,060,453 | A | | 10/1991 | Alberghini et al. | |
| 5,090,180 | A | | 2/1992 | Sorensen | |
| 5,143,211 | A | | 9/1992 | Miczka et al. | |
| 5,732,528 | A | * | 3/1998 | Peronek et al. | 53/201 |
| 5,778,639 | A | * | 7/1998 | Sireix | 53/432 |
| 5,809,741 | A | | 9/1998 | Tovey | |
| 5,819,507 | A | | 10/1998 | Kaneko et al. | |
| 6,003,728 | A | | 12/1999 | Elliott | |
| 6,165,523 | A | | 12/2000 | Story | |
| 6,435,383 | B1 | | 8/2002 | Lee | |
| 6,517,878 | B2 | | 2/2003 | Heczko | |
| 6,523,330 | B1 | | 2/2003 | Hurd | |
| 6,755,298 | B1 | | 6/2004 | Heuft et al. | |
| 6,908,011 | B2 | | 6/2005 | Cho | |
| 6,935,493 | B2 | | 8/2005 | Cho | |
| 6,962,254 | B2 | | 11/2005 | Spector | |
| 6,974,024 | B2 | | 12/2005 | Cho | |
| 6,994,211 | B2 | | 2/2006 | Cho | |
| 7,017,735 | B2 | | 3/2006 | Carlson | |
| 7,028,857 | B2 | | 4/2006 | Peronek | |
| 7,070,046 | B2 | | 7/2006 | Cho | |
| 7,083,043 | B2 | | 8/2006 | Sharon | |
| 7,325,372 | B2 | | 2/2008 | Bernhard | |
| 7,503,453 | B2 | | 3/2009 | Cronin et al. | |
| 7,546,919 | B2 | | 6/2009 | Lee | |
| 7,617,929 | B2 | | 11/2009 | Lee et al. | |
| 7,748,526 | B2 | | 7/2010 | Iwatschenko | |
| 2002/0119222 | A1 | | 8/2002 | Searle et al. | |
| 2003/0222102 | A1 | | 12/2003 | Cho | |
| 2004/0187441 | A1 | | 9/2004 | Cirio | |
| 2007/0006550 | A1 | | 1/2007 | Kemper et al. | |
| 2007/0163898 | A1 | | 7/2007 | Smith et al. | |
| 2010/0012532 | A1 | | 1/2010 | Frutin | |
| 2010/0163442 | A1 | | 7/2010 | Lee et al. | |
| 2010/0187142 | A1 | | 7/2010 | Lee et al. | |

* cited by examiner

PACKAGED BOTTLE BEVERAGE HAVING AN INGREDIENT RELEASE CLOSURE WITH IMPROVED ADDITIVE RELEASE AND METHOD AND APPARATUS THEREOF

PRIORITY CLAIM AND CROSS REFERENCES

The present application is a national phase patent application corresponding to international patent application serial no. PCT/US09/40767 entitled "A PACKAGED BOTTLE BEVERAGE HAVING AN INGREDIENT RELEASE CLOSURE WITH IMPROVED ADDITIVE RELEASE AND METHOD AND APPARATUS THEREOF" and filed on Apr. 16, 2009, and is a continuation-in-part of U.S. non-provisional patent application Ser. No. 12/103,916 now U.S. Pat. No. 8,142,827 entitled "A PACKAGED BOTTLE BEVERAGE HAVING AN INGREDIENT RELEASE CLOSURE WITH IMPROVED ADDITIVE RELEASE AND METHOD AND APPARATUS THEREOF" filed on Apr. 16, 2008, the subject matter of both of which is incorporated herein by reference in its entirety.

TECHNICAL FIELD

The present disclosure relates generally to packaged bottled beverages, and, more particularly, to such packaged bottled beverages having closures which contain compartments therein with additives for release into the bottles upon latter opening of the bottles by consumers and methods and apparatuses for same.

BACKGROUND

Consumers have become increasingly particular with respect to the freshness of food and beverage products. As a result, food and beverage manufacturers have developed packaging which provides such freshness by allowing consumers to mix additional ingredients immediately prior to consumption. For example, yogurt containers are provided with lids having sealed compartments for storing additives such as granola, dried fruit, sugared confections and the like. The consumer opens the sealed compartment and mixes the additives with the yogurt immediately prior to consuming.

Beverage manufacturers are desirous of providing the same experience for consumers with respect to incorporating additives, such as flavors, vitamins, natural ingredients and the like, to base components of beverages immediately prior to consumption. Numerous closures for packaged bottled beverages have been developed which contain a compartment for storing additives. These ingredient release closures have various mechanisms to release the additives. For example, some ingredient release closures contain a frangible seal which may be broken, such as by puncturing, cutting or tearing, to release the ingredient. The frangible seal is typically designed to be broken before the closure is detached from the container, thus allowing the additive stored within the ingredient release closure to combine with the base component of the beverage with minimal spillage of the additive onto a nearby surface or the consumer. Other ingredient release closures utilize plunger type mechanisms which seal an opening between the body of the container and the compartment containing the additive. Upon moving the plunger, the additive is released into the base component of the beverage.

Regardless of the mechanism for releasing the additive into the container, the additive must be sufficiently and quickly eliminated from the ingredient release closure to insure a quality product for the consumer. Sufficient elimination depends in part on construction of the ingredient release closure. The ingredient release closure should be designed to have minimum obstructions between the opening of the compartment and the body of the container, allowing for open flow of the additive from the ingredient release closure into the container. The viscosity of the additive also plays a role in elimination because of its effect on the flow of the additive. Higher viscosity additives, such as those with a syrupy consistency, may have a slower flow rate as compared to lower viscosity additives, such as those with a watery consistency. Problems in managing the flow rate are complicated if the ingredient release closure has an obstructive configuration.

Thus, there exists a need in the art to develop a solution for improving the flow rate of additives such that, when released from an ingredient release closure, such additives may be sufficiently and quickly eliminated so as to immediately mix with the base components in containers.

BRIEF SUMMARY

Briefly described, in a preferred embodiment, the present device overcomes the above-mentioned disadvantages and meets the recognized need by providing a packaged bottled beverage with superior additive delivery having a base component of the beverage in a container under vacuum and separate from an additive in a sealed compartment of an ingredient release closure. Upon opening of the sealed compartment, suction is created forcing the additive to quickly and thoroughly exit the ingredient release closure, a region of higher pressure, and flow into the base component in the container, a region of lower pressure.

Accordingly, one feature and advantage of the present disclosure is its ability to provide a method of improving the delivery of an additive contained within a sealed compartment of an ingredient release closure into a base component of a beverage contained within a vessel of a container by applying compression to the outer surface of the vessel during the capping process to create a vacuum in the container.

Another feature and advantage of the present disclosure is its ability to provide a container closing apparatus in a filling plant that efficiently applies compression to a container during capping, thus creating vacuum within the sealed container.

Yet another feature and advantage of the present disclosure is its ability to provide a system and method for sanitizing of a container cap, wherein cleanliness of a pre-filled cap is assured without any adverse affect to the quality or taste of a packaged bottle beverage.

These and other features and advantages of the present disclosure, will become more apparent to those ordinarily skilled in the art after reading the following Detailed Description and Claims in light of the accompanying drawing Figures.

BRIEF DESCRIPTION OF THE DRAWINGS

Accordingly, the present disclosure will be understood best through consideration of, and with reference to, the following drawing Figures, viewed in conjunction with the Detailed Description referring thereto, in which like reference numbers throughout the various Figures designate like structure, and in which.

Figure 1A:
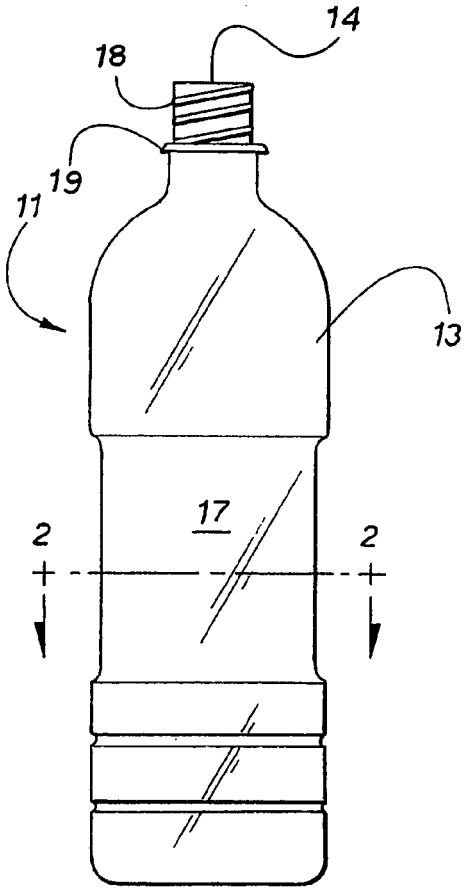
FIG. 1A is a side view of a container of the present disclosure.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION

To the fullest extent permitted by law, the present application claims priority to and the benefit as a patent cooperation treaty application to U.S. non-provisional application Ser. No. 12/103,916, entitled A PACKAGED BOTTLE BEVERAGE HAVING AN INGREDIENT RELEASE CLOSURE WITH IMPROVED ADDITIVE RELEASE AND METHOD AND APPARATUS THEREOF, and filed Apr. 16, 2008, on behalf of inventor James Clayton Bell and Assignee Georgia Crown Distributing Co.

In describing preferred embodiments of the present device and method illustrated in FIGS. 1-11, specific terminology is employed for the sake of clarity. The disclosure, however, is not intended to be limited to the specific terminology so selected, and it is to be understood that each specific element includes all technical equivalents that operate in a similar manner to accomplish a similar purpose.

The present disclosure addresses the performance of packaged bottled beverages that have the additional feature of ingredient release closures containing additives providing consumers with freshly mixed beverages immediately prior to consumption. To insure quality performance of such packaged bottled beverages, the delivery outcome should result in sufficient and quick elimination of the additive from ingredient release closures. Regardless of the structure of ingredient release closures, this outcome may be achieved by providing in one preferred embodiment of the invention a packaged bottled beverage comprising: (a) a beverage comprising a base component and an additive; (b) a container comprising an opening for receiving an ingredient release closure and a vessel containing the base component; (c) the ingredient release closure comprising a sealed compartment containing the additive, a release mechanism for dispensing the additive and attaching means for attachment to the opening of the container; and (d) the attaching means of the closure attached to the opening of the container to form a packaged bottled beverage; wherein the base component is contained under vacuum in the container. In operation, the vacuum in the container creates a pressure differential between the base component and the additive in the ingredient release closure. Upon releasing the additive from the ingredient release closure using the release mechanism and prior to opening the packaged bottle beverage for drinking, the vacuum sufficiently and quickly pulls or draws the additive out of the ingredient release closure to provide a freshly mixed beverage with no spilling or leaking of the base component or additive. A pressure differential between a region of relatively higher pressure, i.e. the additive in the ingredient release closure, and a region of relatively lower pressure, i.e. the base component under vacuum in the container, enables a suction force between the ingredient release closure and the container to pull or draw the additive from the ingredient release closure into the base component in the container. Further, the additive preferably efficiently discharges from the ingredient release closure whereby minimal residual additive remains in the ingredient release closure.

The base component of the beverage may be water, tea, juice, energy drink or the like. The additive may be one or more flavors, vitamins, energy enhancements, natural ingredients or the like and may be in liquid or powdered form. The container may be metal, glass, plastic or the like. Preferably, the container is made from a flexible plastic such as polyethylene terephthalate, commonly referred to as PET. The ingredient release closure may be of any construction having a sealed compartment for containing the additive and a release mechanism such as a plunger, a frangible seal, or the like. Further, the ingredient release closure may be a sports type closure. The attaching means may be a crimped seal, a threaded seal or the like which provides a sufficient seal to prevent ingress of external gases; thereby, undesirably reducing the vacuum in the container. The vacuum may be formed by applying compression to an outer surface of the vessel, by a vacuum pump, by a vacuum chamber, or the like.

Figure 1B:
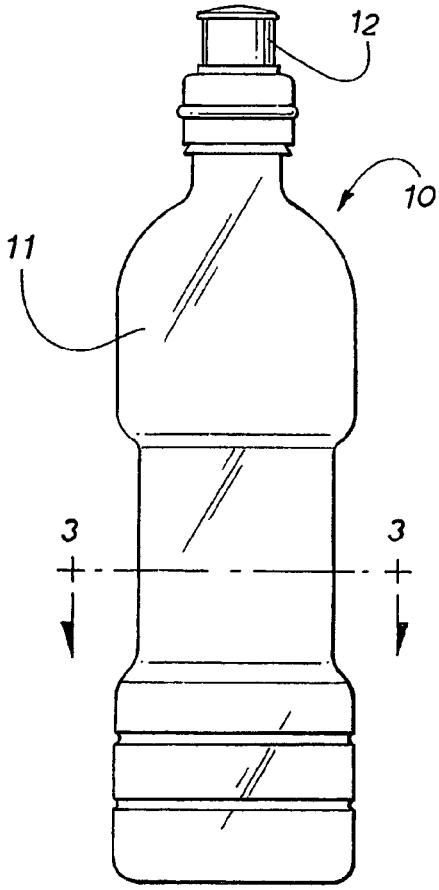
FIG. 1B is a side view of a packaged bottled beverage of the present disclosure.
Figure 2:
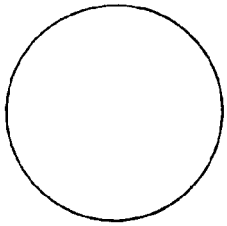
FIG. 2 is a cross-sectional view at line 2-2 of the container of FIG. 1A.
Figure 3:
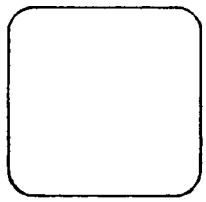
FIG. 3 is a cross-sectional view at line 3-3 of the packaged bottled beverage of FIG. 1B.

With reference to FIGS. 1A and 1B, packaged bottled beverage 10 comprises container 11 and ingredient release closure 12. Container 11 preferably is made of flexible plastic, such as polyethylene terephthalate or the like. Container 11 has vessel 13 for holding the base component of a beverage and opening 14 for receiving ingredient release closure 12. Best seen with reference to FIG. 1B and FIG. 8, ingredient release closure 12, as shown, is preferably a sports closure having sealed compartment 15, release mechanism 16 and spout 20. FIG. 1A represents container 11 when filled with the base component and prior to application of ingredient release closure 12. Vessel 13 has a circular cross-sectional shape in label panel area 17 along line 2-2 of FIG. 1A, as shown in FIG. 2. FIG. 1B represents packaged bottled beverage 10 with ingredient release closure 12 attached to container 11 under vacuum. Under vacuum, in one method of the present disclosure as more fully described below, the cross-section in label panel area 17 is altered by vacuum pressure forces which transform the circular cross-sectional shape into a square cross-sectional shape along line 3-3 of FIG. 1B, as shown in FIG. 3. Alternatively, the cross-sectional shape may take one of a variety of different forms, such as oval.

In use, the consumer activates ingredient release closure 12 by pulling up spout 20 to engage release mechanism 16 and transfer the additive into the base component of the beverage. With other ingredient release closures available in the art, consumers may activate the release mechanism by twisting, applying pressure, or the like depending on the mechanical function of the release mechanism.

In one example, a 0.5 liter lightweight container 11, which is made from 15 to 20 grams of PET, has a pre-vacuum diameter in label panel area 17 along line 2-2 of 6.35 centimeters. Under vacuum, the diameter is reduced to between 5.84 to 4.57 centimeters depending on the viscosity of the additive in ingredient release closure 12. Using a correlation in percentages, the diameter of vessel 13 in packaged bottled beverage 10 is 95% to 65%, preferably 92% to 72%, of the original size diameter of vessel 13 prior to attaching ingredient release closure 12 to container 11. For a 0.7 liter container with circular diameter of 6.92 centimeters, the diameter of packaged bottled beverage 10 would be preferably set to between 6.35 to 4.82 centimeters.

When using a 0.5 liter container 11 made from 20-25 grams of PET, the wall thickness of the vessel 13 is greater. As such, the cross-sectional shape of the vessel 13 may be oval rather than square. The resulting cross-sectional shape of vessel 13 depends upon the amount of compression applied during the capping process as further discussed below. For applications wherein container 11 is made of flexible plastic, the vacuum is preferably created by application of compression to the outer surface of vessel 13, which effectively reduces the diameter of vessel 13. Alternatively, the vacuum is created utilizing a vacuum pump or vacuum chamber, which is effective for flexible and rigid containers alike.

In another preferred embodiment, a method for improving delivery of an additive contained within a sealed compartment of an ingredient release closure into a base component of a beverage contained within a vessel of a packaged bottled beverage comprises the steps of providing a container, a closure and a vacuum means. The container comprises (i) an opening for receiving a closure and (ii) a vessel containing a base component of a beverage. The closure comprises (i) a sealed compartment containing an additive, (ii) a release mechanism for dispensing the additive, and (iii) attaching means for attachment to the opening of the container. Preferably, in one simultaneous operation, the closure is attached to the opening of the container and a vacuum is created with the vacuum means to form a packaged bottled beverage with a container under vacuum. Preferably, the container is a flexible container and the vacuum means is provided by applying compression to an outer surface of the vessel of the container. The compression is preferably applied to the outer surface of the vessel by an adjustable rail having a decreasing arc from a point of initial contact with the container to a point of final contact with the container. Other structures, such as plungers, projectors, opposing plates, rollers or the like, may be used to apply to the outer surface of the vessel. Alternatively, the vacuum means is provided by a vacuum pump or vacuum chamber.

With reference to FIGS. 4-7, another preferred embodiment of the invention shows container closing apparatus 40 in a bottled beverage filling plant, which conventionally includes rotatable capper star 41, rotatable capper mechanism 42 (partially shown), and fixed rear guide 43 spaced radially outwardly from capper star 41 for retaining containers 11 within capper star 41. Additional star wheel mechanisms are strategically situated to assist movement of containers 11 into and out of the capper star 41. A transfer star 44 is mated to capper star 41 and feeds filled containers 11 into capper star 41 at inlet 45. Discharge star 46 is mated to capper star 41 and transfers sealed containers 11*a* from outlet 47 of capper star 41. Both transfer star 44 and discharge star 46 have a rotatable star wheel mechanism having a plurality of pockets adapted to receive containers.

Capper star 41 is a rotatable star wheel mechanism having a plurality of capper pockets 48 adapted to receive containers 11 fed in an assembly line fashion thereto. Overlying capper star 41 is capper mechanism 42, such as a turret capper head, which rotates in synchronism with wheel 49 of capper star 41. Capper mechanism 42 has a plurality of capper heads 50, designed to apply ingredient release closures 12 to threaded neck 18 of containers 11 as shown in FIG. 1A. Best seen with reference to FIG. 7, capper heads 50 may employ a clutch mechanism whereby capper head 50 is rotated and driven axially downward at a predetermined force and torque limiting value to tighten ingredient release closures 12 onto threaded neck 18 of container 11. Fixed rear guide 43 extends between inlet 45 and outlet 47 of capper star 41. Fixed rear guide 43 is spaced radially outwardly from capper star 41 and functions to retain containers 11 in capper pockets 48 and in axial alignment with capper mechanism 42 as capper star 41 rotates. Capping mechanism 42 is preferably used to apply, ingredient release closures 12 of the type having threading onto threaded neck 18 of containers 11, such as plastic PET is containers. Plastic container 11, shown in FIG. 1A, is preferably of the type that has flange 19 extending radially outwardly from threaded neck 18 and positioned a spaced distance below threaded neck 18.

In the operation of container closing apparatus 40, filled containers 11 are rotated in a first direction by transfer star 44 to inlet 45 on capper star 41, which rotates in a direction opposite the direction of rotation of transfer star 44. Ingredient release closures 12 are supplied to filled containers 11 preferably through supply channel 100, partially seen in FIG. 8, of capper mechanism 42, but may also already be placed on threaded necks 18 prior to entering capper mechanism 42. Capper mechanism 42 has rotation means to attach ingredient release closures 12 to filled containers 11. Sealed containers 11*a* with tightened ingredient release closures 12 thereon are rotated out of capper star 41 at outlet 47 to discharge star 46 rotating in the same direction as transfer star 44 and from thence to a conveyor leading to further processing or handling equipment.

Upon entering container closing apparatus 40, container 11 is received by capping star 41 in specially contoured capper pocket 48, which is preferably semi-circular in shape and of a diameter similar to that of the diameter of container 11 which it engages. Best seen with reference to FIG. 5, container 11 is preferably held and suspended at threaded neck is 18, in which the underside of flange 19 rests on top on upper ledge 51 of capper pocket 48. Panel 17 of container 11 is supported by fixed rear guide 43 of capper star 41 to hold container 11 in vertical alignment during the capping operation.

Figure 4:
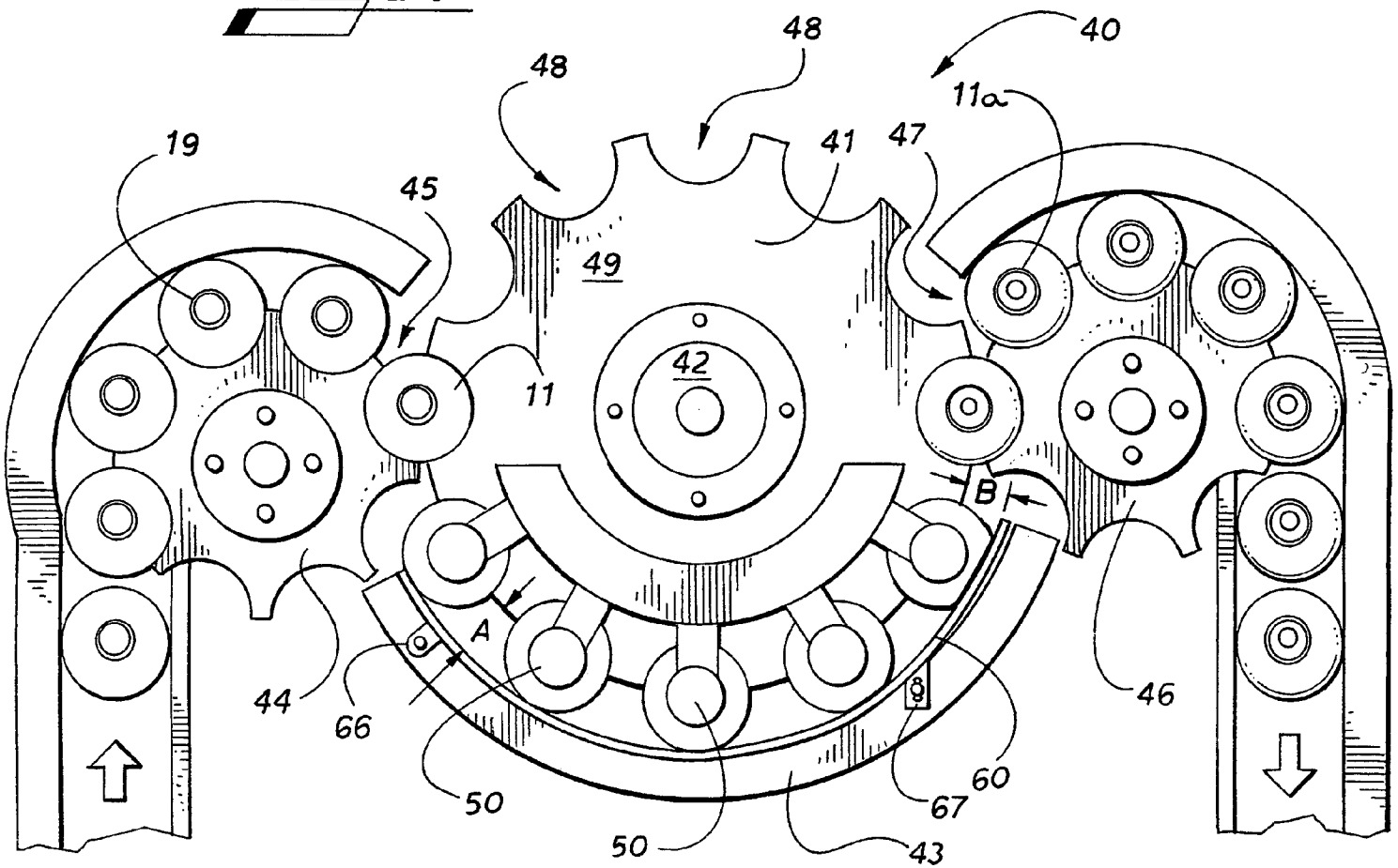
FIG. 4 is a schematic illustration of a capper star wheel mechanism employed in the apparatus and method of the present disclosure.
Figure 5:
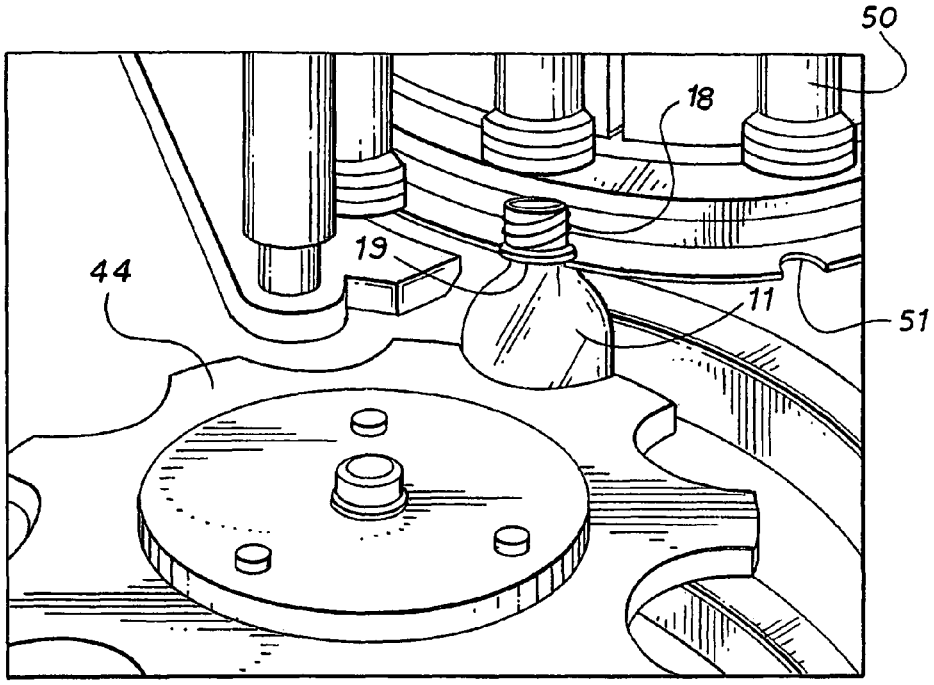
FIG. 5 is a perspective view of a container entering a container closing apparatus according to the apparatus and method of the present disclosure.
Figure 6:
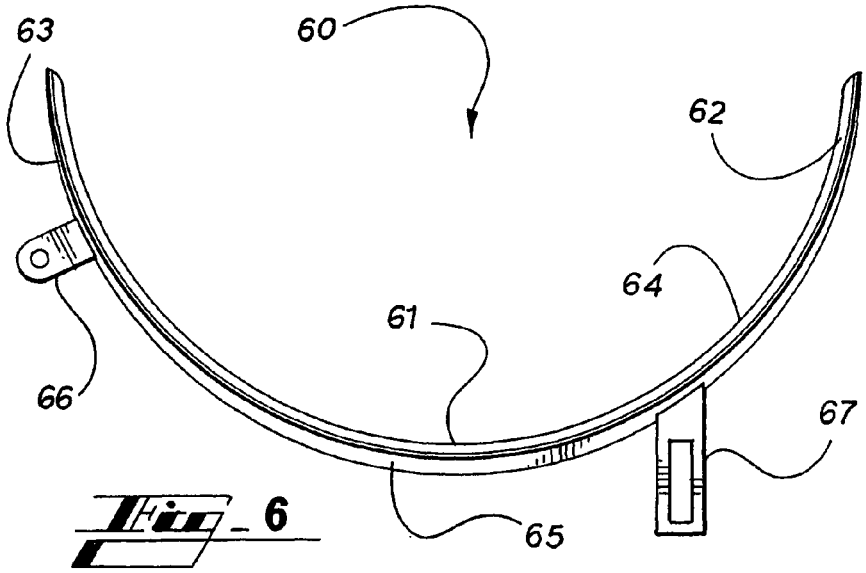
FIG. 6 is a top perspective view of an adjustable rail employed in the apparatus and method of the present disclosure.
Figure 8:
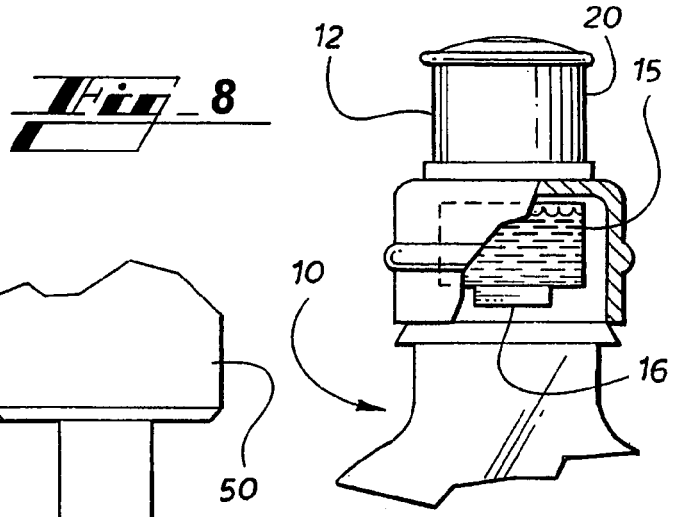
FIG. 8 is a cut away view of an ingredient release closure sealed to the top of a container.

Adjustable rail 60, as shown in FIG. 6, has arcuate member 61 having proximate end 62, distal end 63, curved inner wall 64, and straight outer wall 65. Fixed fastening means 66 is located at distal end 63 and adjustable fastening means 67 is located at proximate end 62. With reference to FIG. 4, adjustable rail 60 is attached to fixed rear guide 43 with an arc of decreasing radius relative to fixed rear guide 43. The radius is decreased by securing fixed fastening means 66 near inlet 45 of capper star 41 and securing adjustable fastening means 67 near outlet 47 of capper star 41. Fixed fastening means 66 preferably is a nut and bolt that passes through a hole of substantially the same diameter. Adjustable fastening means 67 preferably is a nut and bolt that passes through a slot, which allows for adjustment of arcuate member 61 at a decreasing radius relative to the radius of fixed rear guide 43. Adjusting the radius of arcuate member 61 is desirable for use with different size containers 11 or the need to vary the compression applied to containers 11. Any type of fastening means well known in the art may be used for either adjustable fastening means 67 or fixed fastening means 66.

Figure 7:
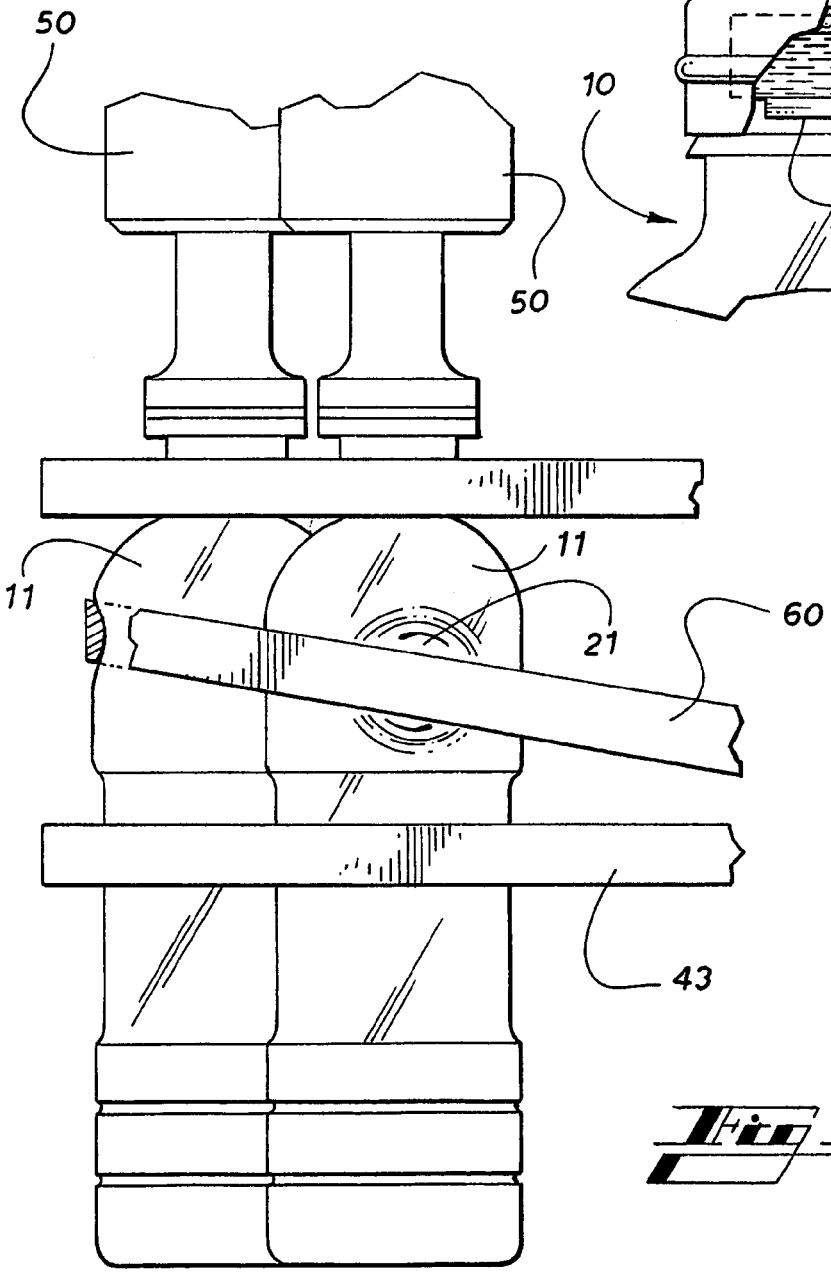
FIG. 7 is a perspective view of a container in contact with the adjustable rail of the container closing apparatus according to the apparatus and method of the present disclosure.
Figure 9:
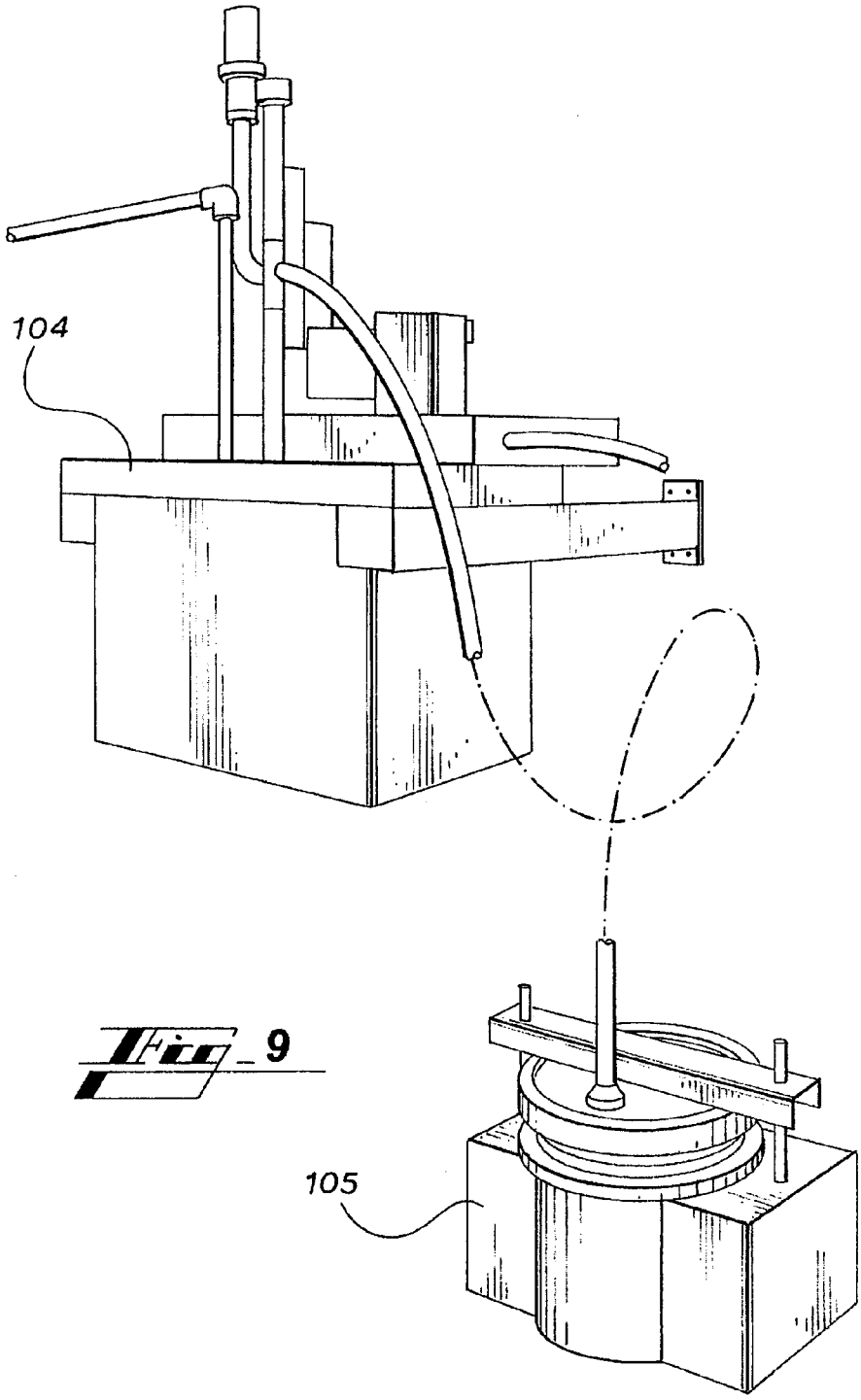
FIG. 9 is a schematic illustration of a metering pump and treatment storage unit for use with the cap treatment mechanism of FIGS. 10 and 11.

With reference to FIG. 4 and FIG. 7, as filled container 11 rotates in capper star 41, adjustable rail 60 comes in contact with filled containers 11 at point A. Upon rotation of filled container 11 by capper star 41, the radius of arcuate member 61 decreases causing adjustable rail 65 to exert compression on outer wall 21 of filled container 11, as shown in FIG. 7. While compression is being applied, filled container 11 is capped with ingredient release closure 12 to form packaged bottled beverage 10 with container 11 under vacuum. Packaged bottled beverage 10 comes off adjustable rail 60 at point B and continues its rotation in capper star 41 until exiting at outlet 47 to discharge star 46. Upon exiting outlet 47, container 11 of packaged bottle beverage 10 changes in shape to adjust to the vacuum created therein. A standard packaged bottle beverage without internal vacuum has a circular cross-sectional shape as shown in FIG. 2. As the internal vacuum in container 11 of packaged bottled beverage 10 exerts negative pressure, the shape of container 11 adjusts preferably to a square cross-sectional shape as shown in FIG. 3.

Figure 11:
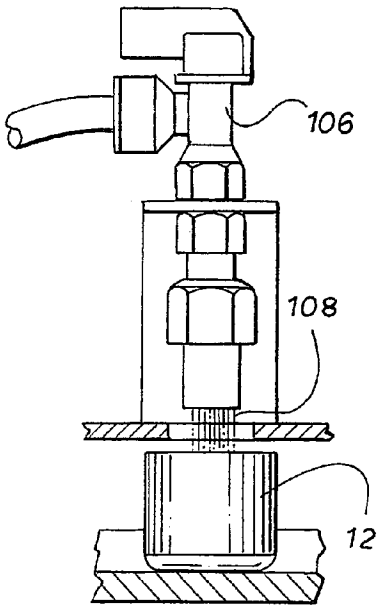
FIG. 11 is a side view of a portion of the cap treatment mechanism of FIG. 10, showing treatment being dispensed into a cap.
Figure 10:
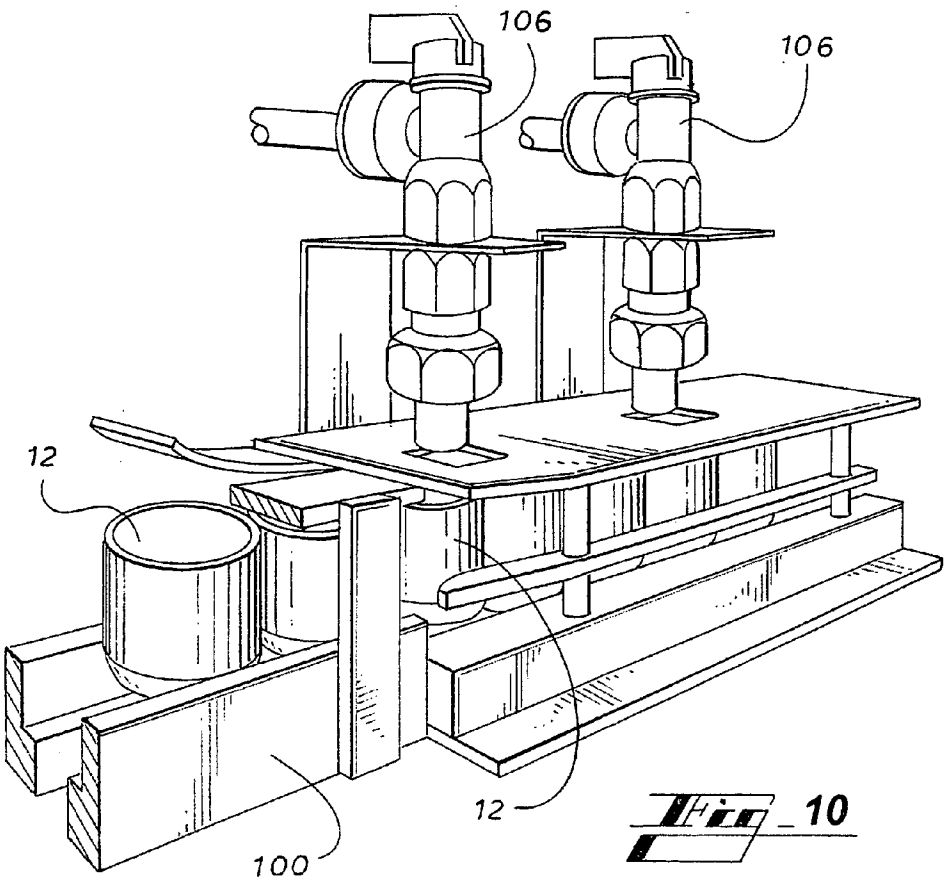
FIG. 10 is a schematic illustration of a cap treatment mechanism employed in the apparatus and method of the present disclosure.

In one embodiment of the present disclosure, ingredient release closures 12 are sanitized prior to placement on threaded necks 18, preferably while in supply channel 100. As generally depicted in FIGS. 10 and 11, ingredient release closures 12 are delivered to capper mechanism 42 by cap chute 102 of supply channel 100. In this preferred embodiment, and as representatively depicted in FIG. 9, supply channel 100 is adapted with metering pump system 104 and storage unit 105, wherein one or more spray nozzles 106 is installed proximate cap chute 102 to spray a metered dose of sanitizer 108 into ingredient release closures 12. According to the preferred embodiment, sanitizer 108 comprises peracetic acid (peroxyacetic acid, PAA); however, other antimicrobial agents with similarly high oxidizing potential, similar effectiveness against microorganisms, and/or other similarly desirable and food safe characteristics may alternately be utilized. The metered delivery of sanitizer 108 by one or more spray nozzles 106 to ingredient release closures 12 proximately prior to placement on threaded necks 18 prevents the inclusion of any undesirable progenerate in packaged bottle beverage 10, effectively sanitizing ingredient release closure 12, yet without affecting taste of packaged bottle beverage 10. Previously known cap sterilization systems, such as ozonated water baths, have not facilitated such an end result, but have been limitingly successful at dust removal from empty caps; nonetheless, such systems would disadvantageously impact the additive of ingredient release closure 12 if employed subsequent to complete assembly of ingredient release closure 12 and proximate to the time of capping of packaged bottle beverage 10.

Having thus described exemplary embodiments of the present invention, it should be noted by those skilled in the art that the within disclosures are exemplary only and that various other alternatives, adaptations, and modifications may be made within the scope and spirit of the present disclosure. Accordingly, the present invention is not limited to the specific embodiments as illustrated herein.

What is claimed is:

1. A packaged bottled beverage comprising:

a beverage comprising a base component and an additive;

a container comprising an opening for receiving a closure and a vessel containing said base component;

an ingredient release closure comprising a sealed compartment containing said additive, a release mechanism for dispensing the additive, and attaching means for attachment to said opening of said container;

said attaching means of said ingredient release closure being attached to said opening of said container, wherein said base component is contained under vacuum in said container and separated from said additive in said sealed compartment, and a cross-sectional shape of said vessel in a label panel area of said vessel is intentionally altered by vacuum pressure forces exerted on said vessel.

2. The packaged bottled beverage of claim 1, wherein upon releasing said additive from said ingredient release closure using said release mechanism and prior to opening said packaged bottle beverage, suction is created pulling said additive from said ingredient release closure into said base component in said container.

3. The packaged bottled beverage of claim 1, wherein said vacuum is formed by applying compression to an outer surface of said vessel.

4. The packaged bottled beverage of claim 1, wherein said vessel of said container comprises a flexible plastic.

5. The packaged bottled beverage of claim 4, wherein said flexible plastic comprises polyethylene terephthalate.

6. The packaged bottled beverage of claim 1, wherein said ingredient release closure comprises a sports closure.

7. The packaged bottled beverage of claim 1, wherein said ingredient release closure is sanitized.

8. The packaged bottled beverage of claim 7, wherein said ingredient release closure comprises a metered dose of sanitizer therein.

9. The packaged bottled beverage of claim 8, wherein said sanitizer comprises peracetic acid.

10. The packaged bottled beverage of claim 1, wherein while said base component is contained under vacuum, a circular cross-sectional shape of said vessel in said label panel area of said vessel is altered by vacuum pressure forces exerted on said vessel so as to transform the circular cross-sectional shape of said vessel into a square or oval cross-sectional shape.

11. The packaged bottled beverage of claim 10, wherein the vacuum pressure forces exerted on said vessel transforms the circular cross-sectional shape of said vessel into a square cross-sectional shape.

12. The packaged bottled beverage of claim 1, wherein a diameter of said vessel is 95% to 65% of an original size diameter of said vessel prior to attaching said ingredient release closure to said container.

13. The packaged bottled beverage of claim 1, wherein said base component comprises water, tea, juice, or an energy drink; and said additive comprises one or more additives selected from flavors, vitamins, energy enhancements, or natural ingredients.

14. The packaged bottled beverage of claim 13, wherein said base component comprises water, and said additive comprises a flavor.

15. A method of making the packaged bottled beverage of claim 1, said method comprising:

applying compression to an outer surface of the vessel during a capping step, said capping step comprising attaching the ingredient release closure to the container via the attaching means of the ingredient release closure.

16. The method of claim 15, wherein the compression is applied to the outer surface of the vessel by an adjustable rail having a decreasing arc from a point of initial contact with the container to a point of final contact with the container.

17. A container closing apparatus in a filling plant configured to carry out the method of claim 15, said container closing apparatus comprising:

an inlet being configured and disposed to permit the container to enter the container closing apparatus;

at least one capper mechanism being configured to attach the ingredient release closure onto the container to form a sealed container;

a container holding apparatus being configured and disposed to receive and hold the container to permit the ingredient release closure to be attached onto the container by said at least one capper mechanism;

a means for creating a vacuum in the space inside the container during attachment of the ingredient release closure onto the container, said means for creating the vacuum is an adjustable rail having an arc of decreasing radius from a point of initial contact with the container at said inlet to a point of final contact with the container at said outlet; and an outlet being configured and disposed to permit the sealed container to exit said container closing apparatus.

18. A packaged bottled beverage comprising:

a beverage comprising a base component and an additive;

a container comprising an opening for receiving a closure and a vessel containing said base component;

an ingredient release closure comprising a sealed compartment containing said additive, a release mechanism for dispensing the additive, and attaching means for attachment to said opening of said container;

said attaching means of said ingredient release closure being attached to said opening of said container, wherein said base component (i) comprises water, (ii) is contained under vacuum in said container, and (iii) is separated from said additive in said sealed compartment, and a cross-sectional shape of said vessel in a label panel area of said vessel is intentionally altered by vacuum pressure forces exerted on said vessel.

19. The packaged bottled beverage of claim 18, wherein said additive comprises one or more additives selected from flavors, vitamins, energy enhancements, or natural ingredients.

20. A packaged bottled beverage comprising:

a beverage comprising a base component and an additive;

a container comprising an opening for receiving a closure and a vessel containing said base component;

an ingredient release closure comprising a sports closure comprising a sealed compartment containing said additive, a release mechanism for dispensing the additive, and attaching means for attachment to said opening of said container;

said attaching means of said ingredient release closure being attached to said opening of said container, wherein said base component (i) comprises water, (ii) is contained under vacuum in said container, and (iii) is separated from said additive in said sealed compartment, and a cross-sectional shape of said vessel in a label panel area of said vessel is intentionally altered by vacuum pressure forces exerted on said vessel.

* * * * *